United States Patent [19]

Häkkinen et al.

[11] 4,177,942

[45] Dec. 11, 1979

[54] SILO DISCHARGING MEANS

[75] Inventors: Seppo Häkkinen; Niilo Nyman; Ossi Kilpeläinen; Ilmari Paakkinen, all of Savonlinna; Kari Rautapaa, Punkasalmi; Seppo Rasimus, Savonlinna, all of Finland

[73] Assignee: Enso-Gutzeit Osakeyhtiö, Helsinki, Finland

[21] Appl. No.: 887,839

[22] Filed: Mar. 17, 1978

[30] Foreign Application Priority Data

Mar. 30, 1977 [FI] Finland ..... 770986

[51] Int. Cl.[2] ..... B65G 3/12

[52] U.S. Cl. ..... 222/198; 222/199; 222/413

[58] Field of Search ..... 222/556, 196, 198, 199, 222/200, 226, 233, 409, 412, 413, 275–277, 269; 198/533

[56] References Cited

U.S. PATENT DOCUMENTS

| | | | |
|---|---|---|---|
| 1,570,795 | 1/1926 | Tainton | 222/200 |
| 2,381,802 | 8/1945 | Booth et al. | 222/200 |
| 3,232,492 | 2/1966 | Carrier | 222/199 |
| 3,272,397 | 9/1966 | Bean | 222/233 |

FOREIGN PATENT DOCUMENTS

| | | | |
|---|---|---|---|
| 110064 | 10/1917 | United Kingdom | 222/198 |

*Primary Examiner*—Robert J. Spar
*Assistant Examiner*—H. Grant Skaggs
*Attorney, Agent, or Firm*—Toren, McGeady and Stanger

[57] ABSTRACT

The discharge opening from a silo is formed by two generally upwardly extending bottom plates placed in a V-shaped configuration. The bottom plates are reciprocatingly movable with the aid of hydraulic cylinders. At their lower ends the bottom plates form an aperture for the discharge of goods from the silo. The bottom plates are pivotally suspended at their top margins. Their lower margins are pivotally interconnected by means of connecting pieces. The hydraulic cylinders are pivotally connected to the connecting pieces and to the bottom plates and the pivotal connections of the connecting pieces to the bottom plates and hydraulic cylinders from a linkage quadrangle. The hydraulic cylinders are arranged to move the linkage quadrangle thus produced, in such a manner that the bottom plates will swing reciprocatingly about their top edges or margins.

7 Claims, 2 Drawing Figures

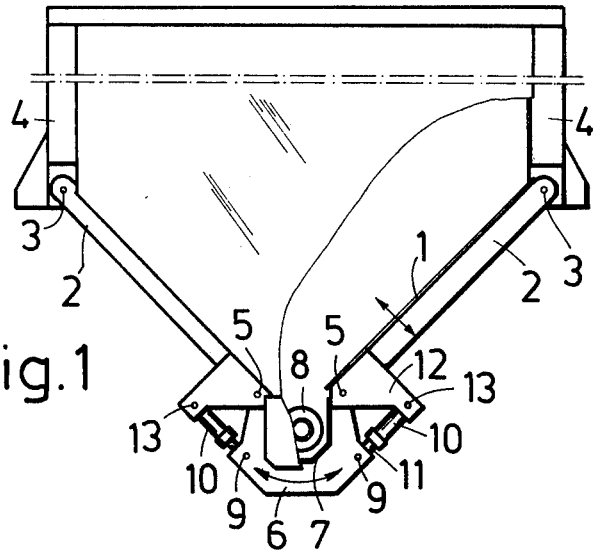
Fig.1
Fig.2
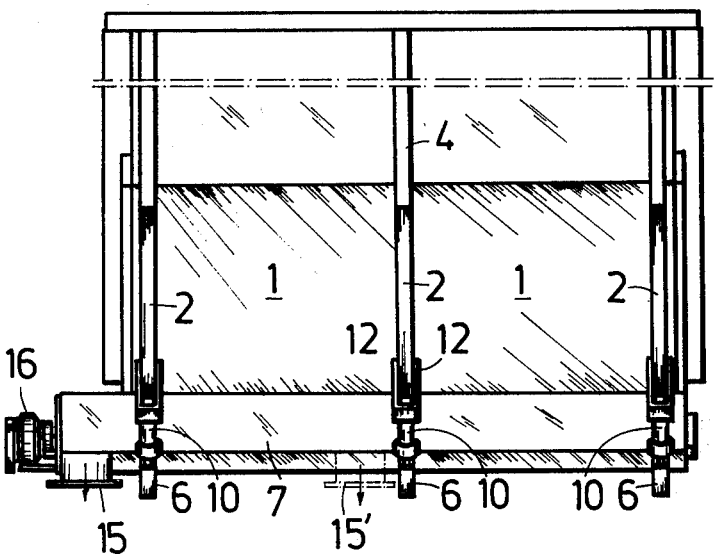

SILO DISCHARGING MEANS

In connection with the storing in silos for instance of wood chips for use in cellulose manufacturing the chips tend to build up to a vault with the consequence that it is difficult to induce the chips to discharge in sufficient amount. Many different solutions have been suggested to this problem posed by the vault formation, one of them being presented in the German patent application No. 2.321.998, wherein the bottom of the silo has been made of movable inclined plates through the interstices of which the goods in the silo can discharge. When these plates rise upwardly, they are at the same time displaced towards the draining aperture, thereby pushing the goods along. The bottom plates have been connected by pivots to a drum rotating reciprocatingly above the discharging point and the surface of this drum has been provided with projections, which tend to displace the goods around the drum. The drum is operated by the aid of a drive means external to the silo, over a connecting rod.

An obvious drawback of the above-described silo discharging means is, first, the complicated construction of the drive mechanism.

In addition, the discharging of the goods is not efficient when the bottom plates rise upwardly and move towards the discharging aperture, because hereby the opening between the bottom plates decreases. Since the inclination of the bottom plates does not change, the plates ascending and descending with unchanged orientation, there is no decrease in the friction in the rest of the goods lying on the plates, which would promote the discharging action. Another drawback is the fact that the drum located between the bottom plates is an obstacle to the flow of goods.

The present invention is based on the idea that by changing the inclination of the movable bottom plates with reference to the horizontal plane to be alternatingly steeper and less steep, one may promote the discharging of the goods remaining in the silo. The silo discharging means of the invention is characterized in that the bottom plates are pivotally suspended by their upper margins and that their lower margins have been mutually pivotally connected by means of connecting pieces, and that drive means have been arranged to move the linkage quadrangle thus produced so that the bottom plates swing reciprocatingly about their upper margins. Due to the silo discharging means of the invention the vault-building is efficiently prevented because the goods layer upon the bottom plates of one half is at any moment moving in the direction opposite to that in which the goods layer of the other half moves.

One favourable embodiment of the invention is characterized in that the connecting pieces are U-shaped and that the pivotal points are located at the upper ends of the U legs and that the connecting pieces support a chute underneath the discharge opening for receiving the discharged goods. It is thus understood that, in addition to their primary task, the connecting pieces also serve as supports for the chute.

Another advantageous embodiment of the invention is characterized in that the chute contains a conveyor, such as a screw conveyor for instance, for transporting the goods in its longitudinal direction. While the conveyor is operating goods are discharged from the silo. When the conveyor is stopped, the goods flow also stops.

A third embodiment of the invention is characterized in that in the bottom of the chute there are one or several trapdoors for goods removal. One door may be located at one end of the chute. If there are several doors, they may be distributed uniformly over the whole length of the chute.

The drive means are most appropriately hydraulic or pneumatic pressure cylinders. The pressure cylinders are preferably located between the bottom plate and the connecting piece, but they may also be accommodated elsewhere.

In one embodiment of the invention, the pressure cylinders have been mounted between the lower end of the U-shaped connecting piece and a downwardly projecting lug on the bottom plate. In this manner a sufficient moment arm is obtained for the moving of the bottom plates. On the other hand, short and therefore inexpensive pressure cylinders will do.

A favourable embodiment of the invention is described in the following with reference to the attached drawing, wherein:

FIG. 1 presents the silo discharging means, viewed from one end and partly sectioned, and FIG. 2 shows the silo discharging means of FIG. 1 in elevational view.

As shown in FIG. 1, the silo discharging means of the invention comprises bottom plates 1 sloping downwardly towards the centre-line of the silo in the form of a V and attached to beams 2 spaced from each other in the longitudinal direction of the silo. The plates 1 constitute for the silo a movable bottom, the beams 2 being pivoted by pins 3 to the uprights 4 supporting the side wall of the silo. The beams 2 carrying the bottom plates 1 are at their lower end pivotally attached by pins 5 to connecting pieces 6, which thus have been placed in register with each beam 2 in the longitudinal direction of the silo (FIG. 2). The connecting pieces 6 support a chute 7 housing within itself a screw conveyor 8, rotated by a drive means 16.

The connecting pieces 6 supporting the chute 7 consist, as shown in FIG. 1, of two U-shaped plates spaced with reference to each other and mutually connected not only by the pins 5 in the legs of the U plate, but also by pins 9, affixed to the bow part of the U plate. The pins 9 constitute pivotal attachments for the piston rods 11 of actuating means, such as hydraulic or pneumatic cylinders 10.

The other ends of the hydraulic cylinders 10 are attached by means of pivots 13 to the beams 2, and these pivots 13 may be located on the beams 2 themselves, or as shown in FIG. 1, on the end of lugs 12 extending outwardly at right angles from the beams 2 at such a distance that the hydraulic cylinders 10 will lie parallel to the bottom plates 1. Hereby the advantage is gained that small hydraulic cylinders may be used.

Presented in detail, the silo discharging means of FIGS. 1 and 2 operates as follows.

The chute 7 carried by the connecting pieces 6 is set in reciprocating oscillatory motion by operating simultaneously all hydraulic cylinders in such manner that the hydraulic cylinders on one and the same side move in the same direction. When the piston rods 11 of the hydraulic cylinders 10 on the right side in FIG. 1, for instance, are pushed out, the lower part of the connecting piece 6 is urged to the left and the chute 7 will therefore be tilted. By action of the pivot 5, the right-hand bottom plate 1 turns about the pivot point 3 counterclockwise and its inclination changes. This facilitates the downward discharging of the goods in the silo because the downward moving of the right-hand bottom plate reduces the friction between the goods and the bottom plate.

While the piston rods of the right-hand cylinders are pushed out, the opposite movement is simultaneously effected in the left cylinders, whereby thus the distance between the left pivot 9 of the connecting piece 6 and the pivot 13 is shortened. Hereby the left bottom plate 1 turns about the pivot point 3 counterclockwise and its inclination changes, and a lifting force acts on the goods upon the bottom plate 1 in the left half of the silo. Since the goods in the right half of the silo is permitted to slide downward under gravity effect, while in the left half the bottom plate lifts the goods upwardly, the forces acting in different direction produce on the centre-line a failure zone with such effect that the goods cannot build any vault in this region and, in contrast, are readily discharged into the chute 7, where the screw conveyor 8 moves the goods further to the discharging aperture 15. Furthermore, the forces acting in opposite directions tend to break up larger clumps which may occur in the goods. .

After the piston rods 11 of the left hydraulic cylinders 10 have moved their whole stroke length, they begin in turn to extend outwardly, while correspondingly the piston rods of the cylinders on the right side are retracted, and the bottom plate on the left descends while that on the right ascends, that is, the action just described is repeated in reverse.

The silo discharging means of the invention presents a number of advantages over equivalent means of prior art. First, the discharging is effected mainly by utilization of gravity, whereby little energy is required for the discharging action. Secondly, the silo discharging means is simple as regards its construction and operation, with the consequence of reliability in service. Thirdly, the power requirements of the drive means, such as the hydraulic cylinders, is minimal compared with the quantity of goods handled, because the gravity effect exerted by the goods against the bottom plate which is moving downwardly is used towards moving the other bottom plate upward. It is, moreover, easy to automate the silo discharging means so that it is only operated when the spontaneous discharging of the goods stops.

The invention is not confined to the embodiment presented in the figures, but it may be modified within the scope of the claims. For instance, the discharging screw 8 may be omitted, in which case the discharge of the goods is through trap-doors 15' in the bottom of the chute.

We claim:

1. Improvement in discharging means for a silo comprising side walls including upright supports, and a pair of bottom plates arranged in a V-shaped configuration with said bottom plates extending downwardly from said side walls and inwardly toward one another in the downward direction, said bottom plates each having an upper margin and a lower margin, the lower margin of said bottom plates being spaced apart and forming therebetween a discharge aperture through which goods can be discharged from said silo, and actuating means connected to said bottom plates for moving said bottom plates in a reciprocating manner, wherein the improvement comprises that each said bottom plate is pivotally connected at the upper margin thereof to said side walls, connecting means pivotally connected to each of the lower margins of said bottom plates, said actuating means pivotally connected to said connecting means at locations spaced from the pivotal connection of said connecting means to said bottom plates, the pivotal connections of said connecting means to said bottom plates and to said actuating means forms a quadrangle linkage, and said actuating means arranged for moving the bottom margins of said bottom plates in a reciprocating manner so that said bottom plates pivot about the connections thereof to said side walls.

2. Improvement in discharging means for a silo, as set forth in claim 1, wherein said connecting means comprises U-shaped connecting pieces each having a pair of upwardly extending legs and a lower bow part interconnecting the lower ends of said legs, said connecting pieces being pivotally connected to the lower margins of said bottom plates at the upper ends of the legs thereof, and a chute below the discharge aperture from said silo and arranged to receive discharged goods passing downwardly therethrough.

3. Improvement in discharging means for a silo, as set forth in claim 2, wherein said chute extends longitudinally along the lower margins of said bottom plates, and a conveyor located within said chute for transporting goods in the longitudinal direction thereof.

4. Improvement in discharging means for a silo, as set forth in claim 3, wherein said conveyor is a screw conveyor.

5. Improvement in discharging means for a silo, as set forth in claim 2, wherein said actuating means are piston cylinders.

6. Improvement in discharging means for a silo, as set forth in claim 5, wherein said piston cylinders are extendable and retractable in the direction between a pivotal connection of said piston cylinders to said bottom plate and the pivotal connection of said piston cylinder to said U-shaped connecting piece.

7. Improvement in discharging means for a silo, as set forth in claim 6, wherein each said bottom plate includes lugs attached to and extending outwardly from the lower margin of said bottom plate, each said piston cylinder having one end thereof pivotally connected to one of said lugs and the other end thereof pivotally connected to said lower bow part of one of said U-shaped connecting pieces.

* * * * *